United States Patent [19]

Maisonnave

[11] 4,279,845

[45] Jul. 21, 1981

[54] PROCESS FOR COATING THE INNER WALL OF A FURNACE OR LIKE APPARATUS

[75] Inventor: Pierre Maisonnave, Oye Plage, France

[73] Assignee: Union Siderurgique du Nord et De L'est De La France (USINOR), Paris, France

[21] Appl. No.: 83,275

[22] Filed: Oct. 10, 1979

[30] Foreign Application Priority Data

Oct. 19, 1978 [FR] France ..... 78 29780

[51] Int. Cl.[3] ..... F27D 1/16

[52] U.S. Cl. ..... 264/30

[58] Field of Search ..... 264/30

[56] References Cited

U.S. PATENT DOCUMENTS

| | | | |
|---|---|---|---|
| 609,733 | 8/1898 | Coker | 264/30 X |
| 2,883,708 | 4/1959 | Sim | 264/81 X |
| 4,196,159 | 4/1980 | Brotzman | 264/30 X |

*Primary Examiner*—Thomas P. Pavelko

*Attorney, Agent, or Firm*—Cushman, Darby & Cushman

[57] ABSTRACT

In this process, there is carried out first of all, through orifices formed in the wall of the apparatus and by means of a suitable device, the injection of a first product for filling in the vicinity of the inner face of this wall the porosities of the charge and forming a whole with this charge. After a suitable period of time which ensures that the aforementioned effect is achieved, there is injected a second product which must form the permanent coating under sufficient pressure to be able to slip between the inner wall and the first coat previously formed by taking advantage of the compressibility of the charge. In this way it is possible to spread in a substantially uniform manner on the inner wall of the furnace a product which is capable of constituting the lining. This product is closely applied to the inner wall owing to the pressure of injection without this product contacting the charge of the furnace, the latter having preformed in the course of the operation the function of the necessary temporary form. The process finds application in particular in blast-furnaces.

5 Claims, 1 Drawing Figure

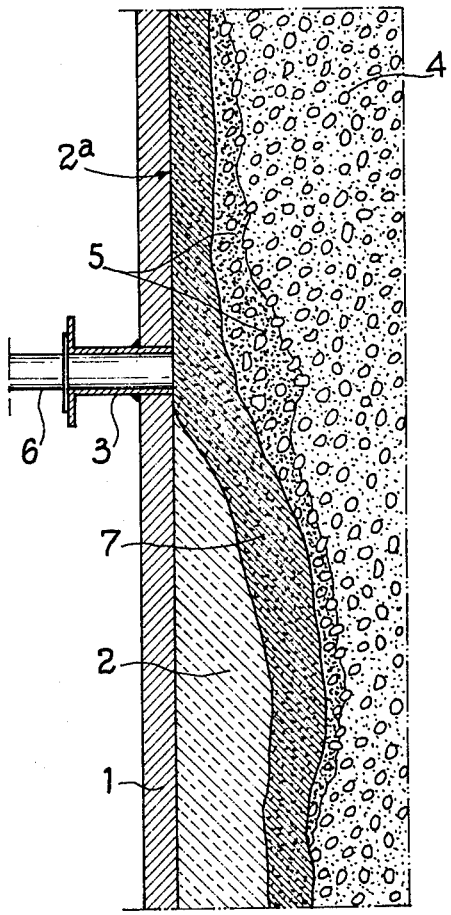
4
2a
5
6
3
7
2
1

PROCESS FOR COATING THE INNER WALL OF A FURNACE OR LIKE APPARATUS

The present invention relates to furnaces normally comprising walls provided on their inner face with refractory or semi-refractory materials.

The maintenance of furnaces in which abrasive charges are treated at medium or high temperature, as in the case of vertical furnaces for lime, dolomite, fire-clay, magnesia, etc., but also horizontal rotating cement and other furnaces, and more particularly blast-furnaces, requires the frequent repairing of their refractory linings, owing to the extreme stresses to which they are subjected.

In certain preferential wear zones, these linings may be destroyed down to the sheet metal within a very short period of time which is in any case less than the life of the remainder of the masonry. Thus, in order to avoid the excessively frequent complete repairing of these linings, many repairing methods have been proposed.

In a first process, the charge is completely or partly emptied and a suitable refractory concrete is projected pneumatically against the walls of the furnace from inside the latter.

The drawbacks of such a process reside in the interruption of the operation of the apparatus, the additional consumption and handling of treated material and also the difficulty of carrying out such an operation.

A second process comprises injecting mechanically, pneumatically or in some other way, from outside the furnace and by way of orifices formed for this purpose, a non-shaped refractory mixture. It is hoped that this material, which adheres to the wall, will form with the charge to a certain thickness a conglomerate which is capable of protecting the wall during a period of time. Generally, the duration of these deposits is short, which is easily explained by the low resistance of their adhesion in the face of the dragging forces due to the movement of the charge which are applied to the heterogeneous excrescence obtained by this method.

More recently, there has been proposed a process which comprises, in order to partly overcome the aforementioned drawback, introducing in the furnace a relatively fluid product as above but by spraying it against the wall by means of suitable devices. Such a solution improves the quality of the connection with the wall but does not eliminate the drawback of trapping the components of the charge and only achieves an unreliable distribution of the treating product. Moreover, the necessity of using a more fluid mixture compromises the rapid setting of the application, above all when the available heat potential is low.

An object of the invention is to overcome the drawbacks of the various known processes examined hereinbefore.

The invention provides a process for maintaining and repairing which may achieve even the reconstitution of the refractory lining of a furnace or like apparatus, wherein there is first injected into the furnace a first product adapted to constitute with the charge a temporary continuous surface against the wall to be treated, then there is introduced under pressure between this layer and the wall of the furnace a second product adapted to form the final lining.

Advantage is taken in the second stage of the compressibility of the charge so that the lining product pushes the charge a sufficient distance away from the wall and occupies the gap thus formed.

The invention will now be described in more detail hereinafter with reference to the accompanying drawing which is given by way of example and in which the single FIGURE is a diagram illustrating the process according to the invention.

There is shown on this drawing an element of a wall of a furnace, which may for example be a blast-furnace, comprising an outer metal case 1 provided with a refractory lining 2 which may have completely disappeared, as shown, in a zone 2*a*. Orifices 3 are formed in this wall so as to permit the injection of the treating product. Located inside the furnace is a charge 4 whose nature depends of course on the use to which the considered furnace is put.

According to the invention, the procedure is the following for the purpose of protecting, maintaining or reconstituting the lining of the furnace:

First of all, there is effected by way of the orifices 3 by means of a suitable mechanical, pneumatic or other device, the injection of a first product 5 which is adapted to fill progressively while it is being introduced, the porosities of the charge in the vicinity of the wall so as to act subsequently as a form on the inner side of the furnace when the final lining product is placed in position.

This first product may of course be of a very variable composition, depending on the conditions of application. It preferably comprises a thermosetting binder so as to take advantage of the temperature of the charge which may be hydraulic, mineral, organic, argillaceous or some other charge.

This composition is usually cheap, since it is neither necessary nor desirable that it possess high mechanical properties.

By way of a non-limitative example, there may be applied by means of a pneumatic spraying machine provided with a nozzle 6, shown in the FIGURE, a hydraulic mortar having the following composition:

| | |
|---|---|
| Particle size 0.2 mm | 600 to 900 kg |
| Portland or alumina cement | 100 to 400 kg |

for a metric ton of the mixture.

The particles may be of very varied nature and chosen in accordance with the local conditions and possible availability: fire-clay, expanded clay, siliceous sand, crushed brick waste, etc. . . but may also be taken from the components of the charge itself, such as, for a blast furnace: particulate slag, ore, or agglomerates. In any case, the particle size of the mixture is so chosen that it can be easily conveyed pneumatically and provides a sufficiently compact structure after setting.

Moreover, the pneumatic spraying has two marked advantages. First, it permits propelling at a sufficient distance from the point of introduction a product containing very little liquid, namely the minimum required for the setting. Secondly, at least in the case where the charge comprises a combustible element such as coke, the conveying air produces a local combustion which gives off an amount of heat which facilitates the following operations.

When a sufficient period of time has elapsed to ensure that the zone of the interface between the furnace wall and the charge has assumed a sufficient temperature and/or that the injected product has become sufficiently set, the injection proper of the second product 7 can be carried out, which requires the introduction thereof under pressure.

This second product is a mortar preferably having a relative high viscosity and setting at a temperature which is appropriate to the local conditions and having a power of adhesion to the furnace wall which is as high as possible.

Under the effect of the pressure, of the order of 2 to 10 bars, provided by the injecting means, which may be for example a pump, this mortar slips between the existing wall and the coated charge and urges the latter back a distance equal to the thickness of the mortar placed in position, this distance being a function of the amount of mortar introduced by way of each orifice 3.

As long as this mortar remains fluid, the pressure applying force is sufficient to achieve the necessary displacement of the charge coated with the layer 5 for an effective pressure within the furnace which does not stress the sheet metal more than in normal operation.

A charge which has hollows and is slightly compact has a compressibility which is quite sufficient in the considered process (at the most a few %).

By way of example, a final mortar may be employed which has the following composition:

| | |
|---|---|
| Mineral charge (refractory) | 40 to 75% by weight |
| Ceramic binder (clay + additives) | 5 to 30% by weight |
| Carbonaceous charge (tar + pitch) | 10 to 30% by weight |
| Organic binder (resins) | 1 to 40% by weight |

The mineral charge may be formed by any refractory or semi-refractory material and in particular fire-clay (argillaceous with a high or very high content of alumina), corundum, silica, silicon carbide, calcinated anthracite, graphite, magnesia, etc. . . The resins are preferably of the phenolic type.

This type of mortar has the advantage of being of reasonable price and capable of being adjusted as concerns viscosity by modifying the relative proportions of tar and resins relative to the charge in accordance with the local conditions.

Further, the setting time may be shortened by adding to the resin polymerization accelerators and the nature of the final ceramic bond may be affected by the introduction of ceramic-forming agents.

The process just described permits the obtainment upon each elementary injecting operation, a substantially uniform and homogeneous distribution of the final mortar on the inner face of the furnace thus treated.

The area covered for a thickness which varies in accordance with the adjustment of the various parameters and above all of the amount of product injected, may be as much as 5 square metres and more on a roughly planar surface. In practice, it is however of interest to treat smaller areas by bringing the orifices 3 as close together as possible. In this case, the good circulation of the final mortar may be often verified by its appearance in the region of the orifices next to that in the course of use.

This facility of circulation also permits the treatment of surfaces having excrescences, such as cooling boxes for example.

The aforementioned layer, which will preferably have a thickness of 5 to 10 cm, firmly adheres to the treated wall and its behaviour in service, measured by the rate at which it wears, is amply sufficient for the needs in practice, especially after ceramic formation has occured on all or a part of the total thickness. This good behaviour is also due to the good adherence to the wall of the final mortar which is due in a large part to the pressure under which it was placed in position.

It will be observed that this process is of use in all furnaces which contain a change to be treated. Thus, by way of a non-limitative example, the process is applicable to a rotating horizontal furnace of the cement furnace type if care is taken to carry out the operation in succession on each fraction of the periphery of the furnace covered by the charge when the furnace is stationary.

It must be understood that many modifications may be made in the process described hereinbefore in accordance with the nature of the refractory lining of the furnace, the treated charge, the temperature of utilization in the various zones or levels of the furnace.

Having now described my invention what I claim as new and desire to secure by Letters Patent is:

1. A process for the maintenance, repairing or reconstitution of the refractory lining of a wall of a furnace or like apparatus by means of a protecting product, comprising first injecting through at least one orifice in the furnace wall a first product adapted to constitute an intermediate layer between a charge contained in the furnace and the protecting product, and then injecting through said orifice, after a sufficient period of time, the protecting product proper between said intermediate layer and the wall of the furnace, said protecting product adhering to the wall and setting to form a repaired surface.

2. A process as claimed in claim 1, wherein the first product is a mortar capable of filling porosities existing between the wall and the charge and forming a whole with the charge.

3. A process as claimed in claim 2, wherein the mortar comprises a cement binder having a hydraulic setting and different particles of inert refractory material.

4. A process for the maintenance, repairing or reconstitution of the refractory lining of a wall of a furnace or like apparatus by means of a protecting product, comprising first injecting a first product adapted to constitute an intermediate layer between the charge and the protecting product, and then injecting, after a sufficient period of time, the protecting product proper between said intermediate layer and the wall of the furnace;

the second product being a mortar capable of strongly adhering to the wall and setting at low temperature and being capable of thereafter resisting high temperatures by developing, when heated, bonds, strongly assembling refractory particles of a mortar suitable for the surface to be treated.

5. A process as claimed in claim 4, wherein the composition of the mortar is:

| | |
|---|---|
| Mineral charge (refractory) | 40 to 75% by weight |
| Ceramic binder (clay + additives) | 5 to 30% by weight |
| Carbonaceous charge (tar + pitch) | 10 to 30% by weight |
| Organic binder (resins) | 10 to 40% by weight. |

* * * * *